US009217311B2

(12) United States Patent
Slup

(10) Patent No.: US 9,217,311 B2
(45) Date of Patent: Dec. 22, 2015

(54) FLAPPER VALVE AND METHOD OF VALVING A TUBULAR

(71) Applicant: Gabriel A. Slup, Spring, TX (US)

(72) Inventor: Gabriel A. Slup, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 311 days.

(21) Appl. No.: 13/668,880

(22) Filed: Nov. 5, 2012

(65) Prior Publication Data

US 2014/0124212 A1 May 8, 2014

(51) Int. Cl.

| | |
|---|---|
| ***E21B 34/08*** | (2006.01) |
| ***E21B 21/10*** | (2006.01) |
| *E21B 34/00* | (2006.01) |

(52) U.S. Cl.

CPC ..... *E21B 34/08* (2013.01); *E21B 21/10* (2013.01); *E21B 2034/005* (2013.01)

(58) Field of Classification Search

USPC ..... 166/373, 321, 381, 332.8; 137/70, 508, 137/521

See application file for complete search history.

(56) References Cited

U.S. PATENT DOCUMENTS

| | | | | |
|---|---|---|---|---|
| 3,189,316 | A * | 6/1965 | Preston, Jr. | 251/74 |
| 2004/0108109 | A1 | 6/2004 | Allamon et al. | |
| 2005/0039922 | A1 | 2/2005 | Vick, Jr. et al. | |
| 2009/0230340 | A1 | 9/2009 | Purkis | |
| 2011/0088907 | A1 | 4/2011 | Xu | |
| 2012/0006553 | A1 | 1/2012 | Korkmaz | |

OTHER PUBLICATIONS

D.S. Aldridge et al., "Economic, Safety, and Performance Considerations for Safety System Design for Large-Bore Gas Completions"; Offshore Technology Conference; OTC paper No. 11881; May 1, 2000; 10 pages.

Gudmund Engen et al., "Reliability of Downhole Safety Valves Used in the North Sea"; Offshore Technology Conference, OTC Paper No. 4355; May 3, 1982, 10 pages.

Thomas G. Hill, Jr., et al., "Development of a Self-Equalizing Surface Controlled Subsurface Safety Valve for Reliability and Design Simplification"; Offshore Technology Conference; OTC Paper No. 8199; May 6, 1996, 8 pages.

International Preliminary Report on Patentability; PCT/US2013/064431; Issued May 5, 2015; 5 Pages.

International Search Report; PCT/US2013/064431; Mailed Jan. 23, 2014; 3 Pages.

Written Opinion of the International Searching Authority; PCT/US2013/064431; Mailed Jan. 23, 2014; 4 Pages.

* cited by examiner

*Primary Examiner* — Taras P Bemko

(74) *Attorney, Agent, or Firm* — Cantor Colburn LLP

(57) ABSTRACT

A flapper valve includes a housing, a seat movably disposed at the housing at least between a first position and a second position, a flapper movably disposed at the seat at least between a seated position and an unseated position and at least two biasing members. A first biasing member is configured to bias the flapper toward the unseated position and the second biasing member is configured to bias the flapper toward the seated position.

16 Claims, 3 Drawing Sheets

FLAPPER VALVE AND METHOD OF VALVING A TUBULAR

BACKGROUND

Flapper valves are commonly used in tubular systems. Typical flapper valves have a flapper that is biased to a normally closed position. This configuration allows pressure from one side of the valve to open the flapper to allow flow therethrough while automatically blocking flow in the opposing direction. Although such valves work well for their intended purpose new valves that allow more options of biasing a flapper and thereby allowing flow therethrough in additional directions are well received in the art.

BRIEF DESCRIPTION

Disclosed herein is a flapper valve. The flapper valve includes a housing, a seat movably disposed at the housing at least between a first position and a second position, a flapper movably disposed at the seat at least between a seated position and an unseated position and at least two biasing members. The first biasing member is configured to bias the flapper toward the unseated position and the second biasing member is configured to bias the flapper toward the seated position.

Further disclosed herein is a method of valving a tubular. The method includes biasing a flapper toward a seated position, seating the flapper against a seat, pressuring up against the flapper while seated, moving the seat relative to a housing, biasing the flapper to an unseated position, and unseating the flapper from the seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
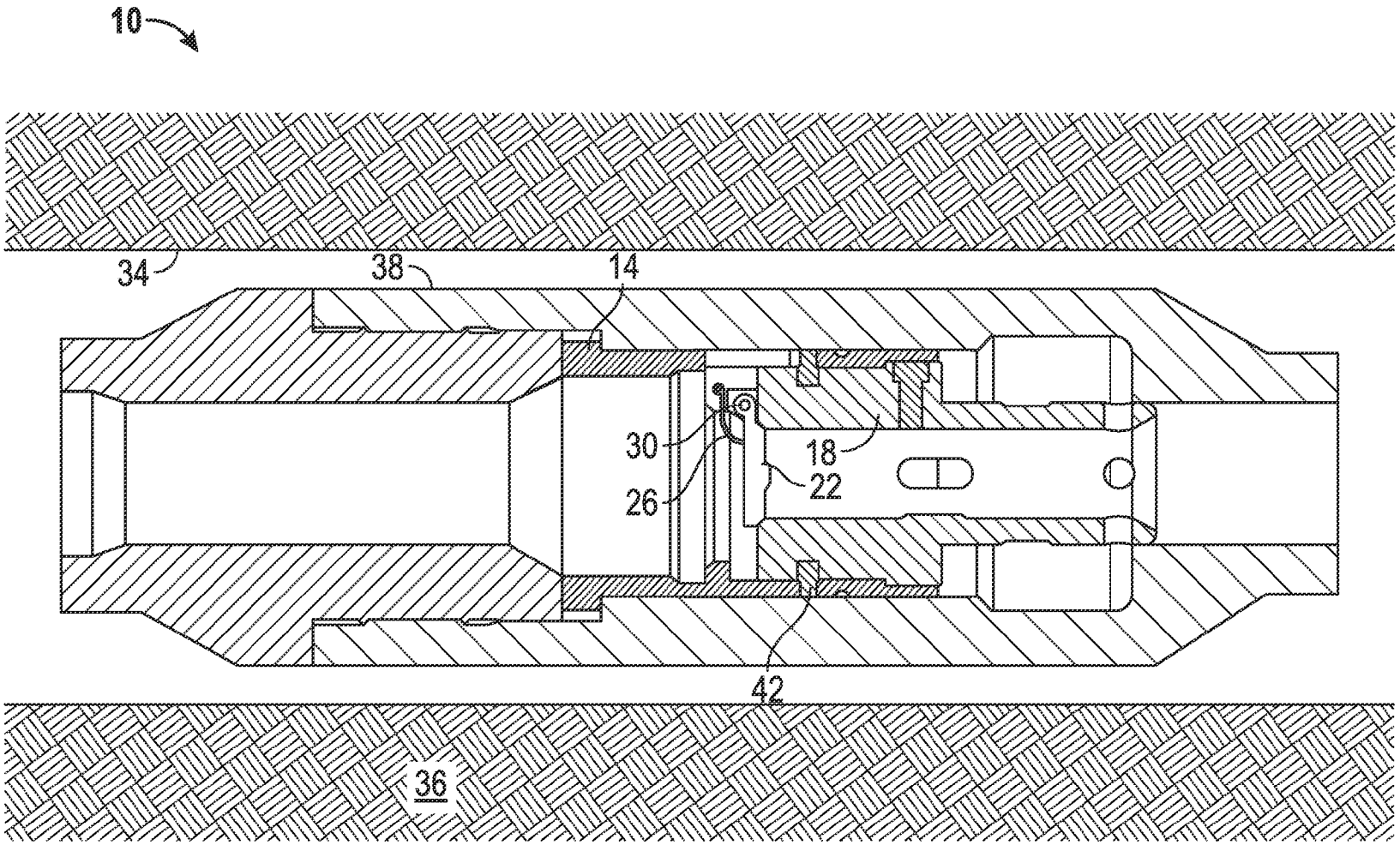
FIG. 1 depicts a cross sectional view a flapper valve disclosed herein, with a flapper in a seated position, while positioned within a borehole.
Figure 2:
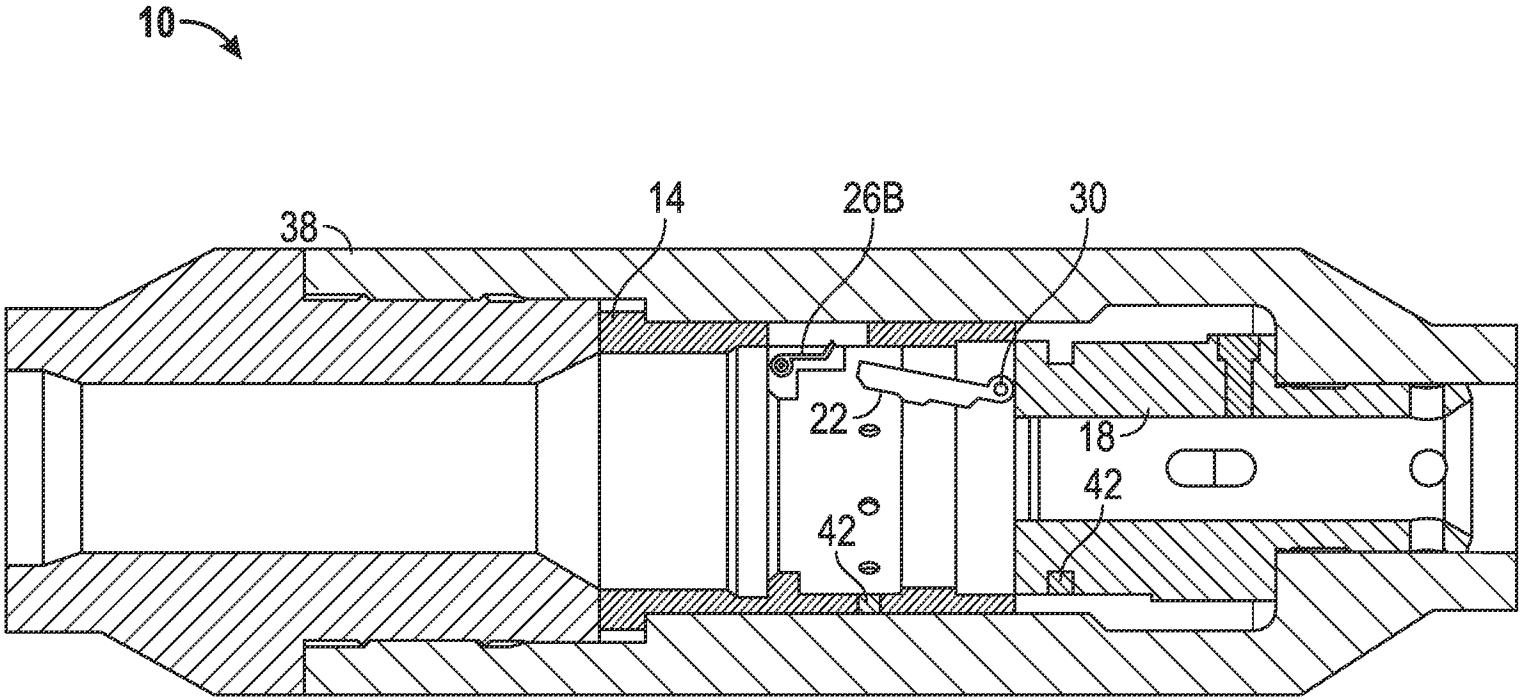
FIG. 2 depicts a cross sectional view of the flapper valve of FIG. 1 shown with the flapper in an unseated position.
Figure 3:
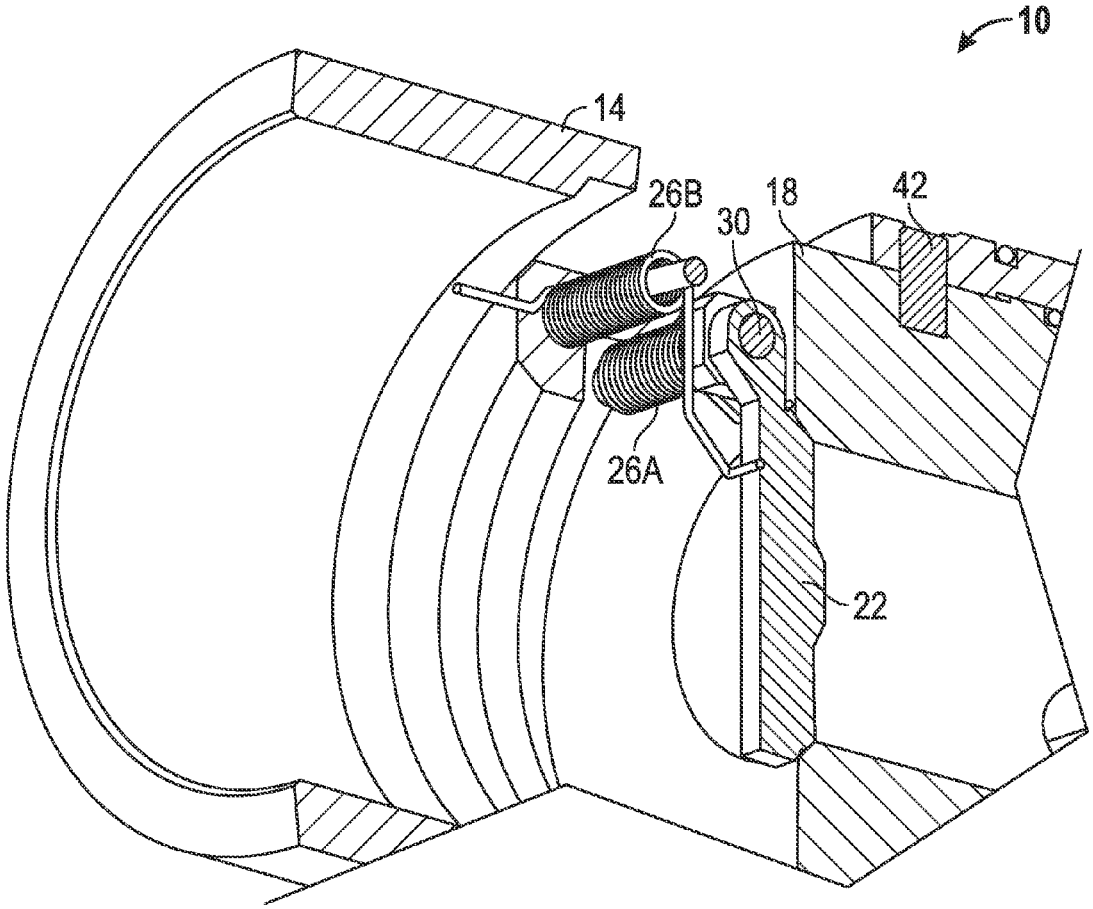
FIG. 3 depicts a partial magnified cross sectional perspective view of a portion of the flapper valve of FIG. 1 with the flapper in the seated position.

Referring to FIGS. 1-3, an embodiment of a flapper valve disclosed herein is illustrated at 10. The flapper valve 10 includes, a housing 14, a seat 18, a flapper 22 and at least one biasing member 26. The flapper 22 is movably attached to the seat 18 by a hinge 30 that allows the flapper 22 to move at least between a seated position (as shown in FIGS. 1 and 3) and an unseated position (as shown in FIG. 2). The seat 18 is slidably sealingly engaged within the housing 14 and is movable at least between a first position (as shown in FIGS. 1 and 3) and a second position (as shown in FIG. 2). And the at least one biasing member 26 as illustrated in this embodiment consists of two biasing members, a first biasing member 26A and a second biasing member 26B, both of which are shown as torsion springs. The flapper valve 10 is configured such that both of the biasing members 26A, 26B bias the flapper 22 when the seat 18 is in the first position but only the first biasing member 26A biases the flapper 22 when the seat 18 is in the second position. The two biasing members 26A, 26B bias the flapper 22 in opposite directions. The first biasing member 26A biases the flapper 22 toward the unseated position while the second biasing member 26B biases the flapper 22 toward the seated position. The second biasing member 26B has a stronger biasing force than does the first biasing member 26A. As such, when the seat 18 is in the first position the greater force of the second biasing member 26B overcomes the force of the first biasing member 26A thereby moving the flapper 22 to the seated position such that the flapper valve 10 is normally closed. Once the seat 18 has moved to the second position and the second biasing member 26B no longer biases the flapper 22 the sole biasing force of the first biasing member 26A urges the flapper 22 to the unseated position. These movements are assuming that no other forces are acting upon the flapper 22 such as pressure, for example, as is discussed in detail below.

The foregoing structure allows the flapper valve 10 to be normally closed (seated), when the seat is in the first position, due to the biasing members 26A, 26B maintaining the flapper 22 in the seated position. However, forces acting against the flapper 22 in a direction to unseat the flapper 22, such as pressure built to the right of the flapper 22 in the Figures (can exceed the biasing force of the second biasing member 26B) and can force the flapper 22 open (to the unseated position). Such pressure can be built while running the flapper valve 10 into a fluid filled borehole 34, such as a wellbore in an earth formation 36, for example, when employed in a tubular 38 (i.e. casing or drill string) thereby allowing the fluid to flow through the unseated flapper 22 in the process. Conversely, when pressure against the flapper 22 (left of the flapper 22 in the Figures) when in the seated position is greater than pressure to the right of the flapper 22, the flapper 22 is forced against the seat 18 with even greater force. This force urges the seat 18 relative to the housing 14 and can move the seat 18 when sufficient force is attained. Such force can be that required to overcome friction between the seat 18 and the housing 14 or can be that required to release a releasable member 42 configured to maintain the seat 18 in the first position until a selected force is exceeded, after which the seat 18 is movable to the second position. The releasable member 42 illustrated herein is a plurality of shear screws although other embodiments are contemplated such as snap rings and detents, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A flapper valve comprising:

a housing;

a seat movably disposed at the housing at least between a first position and a second position;

a flapper movably disposed at the seat at least between a seated position and an unseated position; and a first biasing member being configured to bias the flapper toward the unseated position and a second biasing member configured to bias the flapper toward the seated position.

2. The flapper valve of claim 1, wherein the seat is movable from the first position to the second position in response to pressure being applied against the flapper when in the seated position.

3. The flapper valve of claim 1, further comprising at least one release member configured to maintain the seat in the first position until a force exceeding a selected release force is applied against the seat relative to the housing.

4. The flapper valve of claim 1, wherein the second biasing member allows the flapper to move to the unseated position, while the seat is in the first position, in response to pressure downstream of the seat being greater than pressure upstream of the seat.

5. The flapper valve of claim 1, wherein the flapper is movable with the seat while seated as the seat moves between the first position and the second position.

6. The flapper valve of claim 1, wherein a biasing force of the second biasing member is greater than a biasing force of the first biasing member.

7. The flapper valve of claim 1, wherein the second biasing member is biasingly engaged with the flapper when the seat is in the first position and is not biasingly engaged with the flapper when the seat is in the second position.

8. The flapper valve of claim 1, wherein at least one of the first biasing member and the second biasing member is a torsion spring.

9. The flapper valve of claim 1, wherein the seat is in slidable sealing engagement with the housing.

10. A method of valving a tubular, comprising:

biasing a flapper toward a seated position;

seating the flapper against a seat;

pressuring up against the flapper while seated;

moving the seat relative to a housing from a first position to a second position;

biasing the flapper toward an unseated position; and unseating the flapper from the seat.

11. The method of valving a tubular of claim 10, further comprising releasing at least one release member that maintains the seat relative to the housing prior to being released.

12. The method of valving a tubular of claim 10, further comprising preventing flow through the tubular when the flapper is seated.

13. The method of valving a tubular of claim 10, further comprising unseating the flapper with a pressure differential across the flapper.

14. The method of valving a tubular of claim 10, further comprising allowing flow through the tubular when the flapper is unseated.

15. The method of valving a tubular of claim 10, further comprising biasing the flapper toward the unseated position with a first biasing member and toward a seated position with a second biasing member.

16. The method of valving a tubular of claim 10, further comprising maintaining seating of the flapper against the seat while the seat is moved from the first position to the second position.

* * * * *